United States Patent [19]

Cooper

[11] Patent Number: 4,930,986

[45] Date of Patent: Jun. 5, 1990

[54] APPARATUS FOR IMMERSING SOLIDS INTO FLUIDS AND MOVING FLUIDS IN A LINEAR DIRECTION

[75] Inventor: Paul V. Cooper, Cleveland, Ohio

[73] Assignee: The Carborundum Company, Niagara Falls, N.Y.

[21] Appl. No.: 629,526

[22] Filed: Jul. 10, 1984

[51] Int. Cl.[5] ..... B63H 1/16

[52] U.S. Cl. ..... 416/189

[58] Field of Search ..... 416/189 R

[56] References Cited

U.S. PATENT DOCUMENTS

| | | | |
|---|---|---|---|
| 506,572 | 10/1893 | Wagener | 416/189 R |
| 1,454,967 | 5/1923 | Gill | 416/189 R |
| 1,518,501 | 12/1924 | Gill | 416/189 R |
| 2,091,677 | 8/1937 | Fredericks | 416/189 R |
| 3,487,805 | 1/1970 | Satterthwaite et al. | 416/189 R |
| 3,512,762 | 5/1970 | Umbricht | 416/189 R |
| 4,370,096 | 1/1983 | Church | 416/189 R |

*Primary Examiner*—Louis J. Casaregola

*Attorney, Agent, or Firm*—R. Lawrence Sahr

[57] ABSTRACT

An impeller assembly is disclosed which is arranged to produce linear flow of fluid which prohibits radial flow of that fluid. An impeller is surrounded by a hollow cylindrical section mounted and fixed to the periphery of the impeller blades. The cylindrical section may extend either beyond the leading edges of the impeller blades or beyond the trailing edges of the impeller blades, or both, along the axis of rotation of the impeller assembly.

9 Claims, 5 Drawing Sheets

APPARATUS FOR IMMERSING SOLIDS INTO FLUIDS AND MOVING FLUIDS IN A LINEAR DIRECTION

BACKGROUND OF THE INVENTION

1. Field of the Invention

The present invention relates generally to the field of fluid dynamics and specifically to both the field of immersing low density and/or high surface area to volume solids into liquids and the field of moving fluids in a linear path.

2. Description of the Prior Art

Axial impellers are well known to those with skill in the field as a means for generally moving fluids in a direction which is parallel to the axis of rotation of such impellers. Axial flow impellers are generally categorized as one of two specific types: the first is a propeller, as conventionally used in marine applications; and the second is a turbine as conventionally found in various designs of liquid pumps. The marine propeller is generally characterized as being of a square pitch design, that is it has a variable angle and, therefore, an approximately constant radial pitch across the face of the impeller. The turbine, as distinguished, has a constant blade angle and therefore a variable radial pitch across the face of the impeller. Both types of impellers are used to move fluids in a generally linear direction.

It is well known that the operation of axial impellers, including both propellers and turbines, to varying extents, creates radial turbulence and ancillary radial flow, adjacent the circumferential periphery of the blades of the impeller, in a direction which is perpendicular to the impeller's axis of rotation. This radial turbulence tends to roll and tumble in a direction opposed to the direction of the linear flow of fluid passing through the impeller. The rolling and tumbling motion of the fluid created by the radial turbulence tends to roll and tumble into the path of the fluid entering the impeller, thus impeding and decreasing the linear flow of fluid into that impeller. The net result is that the speed of the impeller rotation must be increased to overcome the effects of the radial turbulence in order to maintain a desired volume of flow in a linear direction through the impeller. In addition, fluid which has just previously been passed through the impeller and radially expelled therefrom, followed by being rolled and tumbled in an opposite direction, tends to be immediately recirculated through the impeller, thus curtailing the flow of virgin fluid through that impeller. To move a desired volume of virgin fluid, per unit of time, through the impeller, the speed of the impeller's rotation must be even further increased. Thus, these increases in speed, combined with the radial turbulence and the rolling and tumbling motion of that turbulence, in an opposite direction, creates what is well known as a vortex effect.

A vortex effect is similar to the effect produced by a whirlpool and is characterized by much turbulence surrounding both the periphery of the axial impeller and the fluid entering that impeller. The vortex effect also tends to decrease the efficiency of the movement of fluid being expelled from the impeller in a linear direction, in that the rolling and tumbling action involved in the turbulence tends to redirect the linear flow into an arced or fanned direction.

The foregoing phenomena are good for localized mixing applications, using a stationary impeller, but are detrimental to systems where linear fluid movement is the object. In a marine application, using a propeller, the problems created by the turbulence of the vortex effect are overcome by the fact that the propeller moves along with its drive unit and the boat to which it is attached. Thus, the propeller is always moved forward ahead of the vortex effect and pushes against it. In a turbine application, such as a pump, the problem of the vortex effect is overcome by encasing the impeller into a stationary casing which closely surrounds the blades of the turbine and provides only an opening for the linear flow. Thus, if no radial flow can occur because of the closely adjacent encasement of the turbine, no vortex effect is created and the flow pattern is confined to a linear direction.

Axial flow impellers of both the propeller and the turbine design are commonly used in mixing apparatus, as inferred above, such as, for example, by placement of the impeller into a large tank with the walls of such tank being a substantial distance away from the blades of the impeller. If the impeller is placed near the surface of the fluid in such a tank, the vortex effect created by the radial turbulence can create a fluid void at the surface, in the form of a conical section converging from the surface of the liquid towards the center of the impeller. The flow of fluid surrounding the void creates a low pressure zone which causes the ambient atmosphere to be sucked into the impeller along with the fluid included in the vortex. Such an inclusion of ambient atmosphere can be detrimental in some applications. An example of such an application is often found where the specific problem is to entrain, into a fluid such as a liquid, either solids having a lighter density than the liquid, or solids having a relatively high surface area to weight ratio such that the surface tension of the liquid tends to hinder rapid sinking, by gravity, of such solids into the liquid. In such situations where it is important to exclude atmospheric gases from the liquid, but the solids "floating" on the surface of the fluid must be induced into the liquid, means are needed to accomplish that objective while eliminating the vortex effect.

If the purpose of the impeller is to linearly move fluid from one zone to another in a large tank, the vortex effect created thereby tends to hinder the efficiency of the inducement of such a linear flow. Thus, there are applications where there is a need for some means to reduce or eliminate the detrimental results of the vortex effect and to more efficiently move fluid in a linear direction.

SUMMARY OF THE INVENTION

The present invention includes an impeller assembly arranged to produce linear flow of fluid in a direction parallel to the axis of rotation of that apparatus. The impeller periphery is surrounded by a drum in a form of a cylindrical section. The drum is mounted to the periphery of the impeller blades and fixed thereto. The cylindrical section may extend concentrically beyond the trailing edges of the impeller blades along the axis of rotation of the impeller. And the cylindrical section may extend concentrically beyond the leading edges of the impeller blade along that same axis of rotation of the impeller. In operation the impeller and the drum are rotated as a single unit. The apparatus may be positioned adjacent to, but sufficiently beneath the surface of a fluid, to enduce a gravity flow of the fluid near that surface, over the portion of the cylindrical section which extends beyond the leading edge of the blades of the impeller. Alternatively, the apparatus may be mounted more deeply into the fluid in a tank or other enclosure and operatured to enduce linear flow of the fluid without a vortex. These features as well as other features of the present invention will be more completely disclosed and described in the following specification, the accompanying drawings and the appended claims.

DETAILED DESCRIPTION

Figure 1:
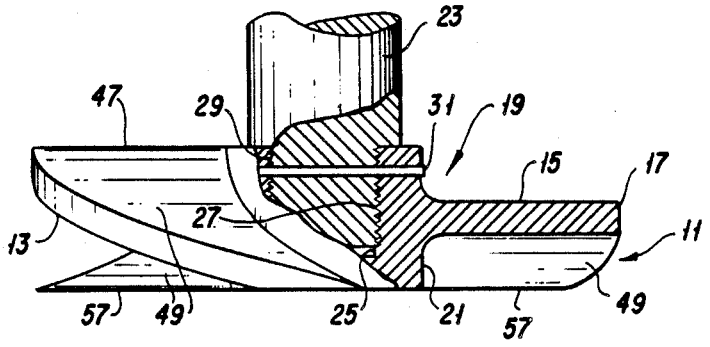
FIG. 1 illustrates an elevational view of the impeller as mounted to a section of the drive shaft with portions cut away.

Referring to FIG. 1 there is shown a square pitch impeller 11 having a variable blade angle 13 and a constant radial pitch 15 across any section of the impeller blades extending from the radial periphery 17 to the center section 19. The general shape of the impeller 11 is a cylindrical volute having a hub 21. The impeller 11 is mounted to a drive shaft 23 by any suitable method.

In the example shown in FIG. 1, the hub 21 includes a bore 25 which is threaded with threads 27. Drive shaft 23 has a correspondingly sized and threaded section 29. Drive shaft 23 is threadably fitted to bore 25 of impeller 11. Bore 25 in impeller 11 is concentrically located to extend along the central axis of rotation of the cylindrical volute of impeller 11 about as shown in FIGS. 1, 2, 4, 5 and 6. Pin 31 may be inserted into a correspondingly sized hole drilled radially through the midpoints of drive shaft section 29 and hub 21, in their fitted together relationship, as shown in FIG. 1. The function of pin 31 is to provide a mechanism to lock drive shaft section 29 into position in hub 21 and thus prevent the unthreading of drive shaft section 29 from threads 27 and bore 25 of hub 21 as both impeller 11 and drive shaft 23 are rotated in unison. Depending on the thread configuration used and the degree of interference fit provided between the mating threads 27 of hub 21 and the threads of drive shaft 29, a pin 31 may not be necessary.

Figure 5:
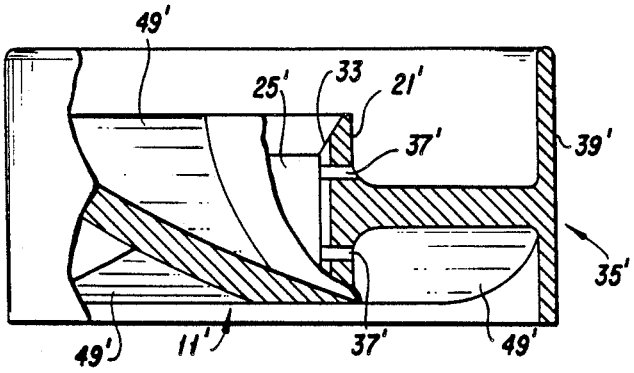
FIG. 5 is an elevational, partly cut away view of alternate embodiment of the impeller assembly where in the impeller drum and impeller are a single piece.
Figure 6:
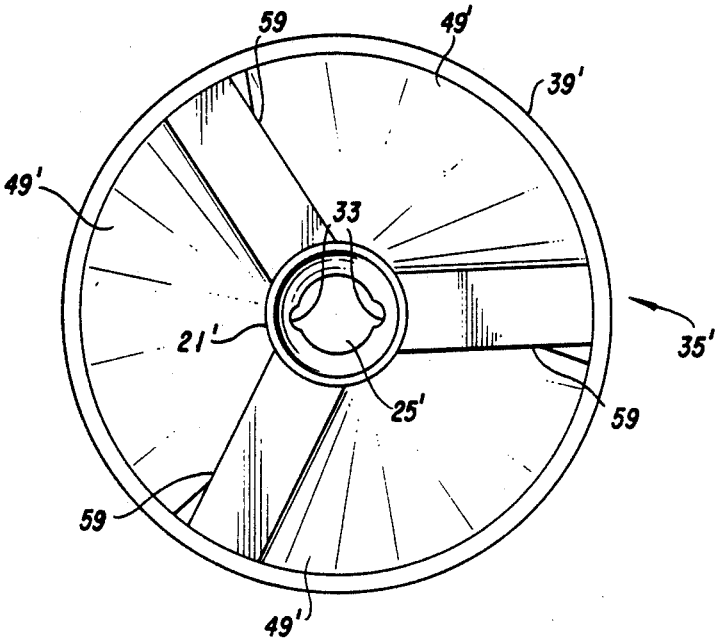
FIG. 6 is a plan view of the alternate embodiment of the impeller assembly as illustrated in FIG. 5.

FIGS. 5 and 6 illustrate alternative means of fixing a drive shaft to the hub 21' of an impeller assembly 35'. Referring to FIGS. 5 and 6, there is shown a hub 21' which includes a bore 25'. Bore 25' contains no threads, however, there are a pair of keyways 33 located adjacent to the outer circumference of bore 25' which extends parallel to the axis of rotation of impeller assembly 35'. A corresponding drive shaft (not shown) is fitted into bore 25', and that drive shaft has complimentary keyways which match the size and location of keyways 33. Keys (not shown) would be inserted to prevent the slippage of impeller assembly 35' in relation to its drive shaft during the rotation of impeller assembly 35' and that drive shaft in unison. In addition, pins similar to pin 31 can be utilized in the impeller assemblies shown in FIGS. 5 and 6, utilizing pin holes 37'.

Figure 3:
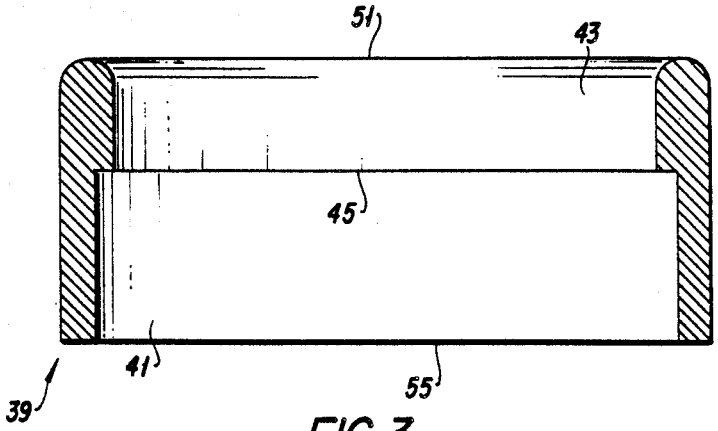
FIG. 3 is an elevational, cross-sectional view of the impeller drum.

Referring to FIG. 3, impeller drum 39 is illustrated. Impeller drum 39 is a hollowed cylindrical section which has a step bore 41 sized to correspond to the outside diameter of the radial periphery 17 of impeller 11. The hollow bore 43 is of a smaller diameter than step bore 41. The height of impeller drum 39 is greater than the overall height of impeller 11 and the height of step bore 41 is preferably greater than the height of impeller 11.

Figure 4:
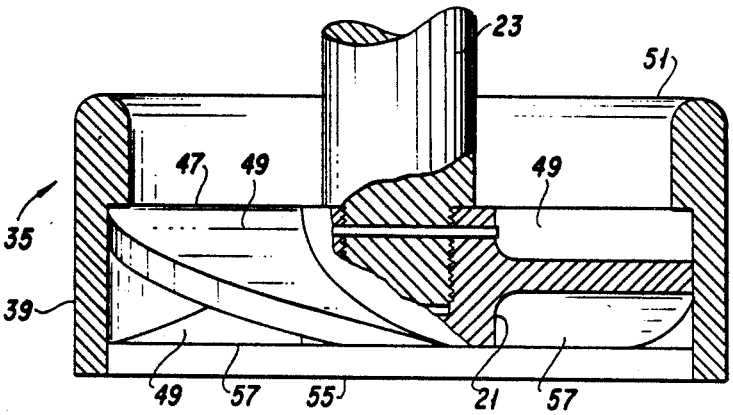
FIG. 4 illustrates the impeller assembly including a cross-sectional view of the impeller drum and a cut away view of the impeller drive shaft.

Referring to FIG. 4, impeller drum 39 is mounted over impeller 11 with the ridge 45 of step bore 41 resting on the leading edges 47 of the impeller blades 49. In viewing FIG. 4, it should be noted that the upper end 51 of impeller drum 39 preferably extends in height above the leading edges 47 of impeller blades 49 and the lower end 55 of impeller drum 39 extends downwardly below the level of the trailing edges 57 of impeller blades 49.

Referring to FIGS. 5 and 6, an alternate embodiment of the combination of the impeller drum 39' and the impeller 11' is found in a design which combines both of these elements into a single piece designated as an impeller assembly 35'. In the embodiment shown in FIGS. 5 and 6, the impeller drum 39' and the impeller 11' are combined into a single piece wherein the impeller drum 39' becomes an extension of the impeller blades 49'. Except as described differently hereinabove all aspects of the design of the alternate embodiment shown in FIGS. 5 and 6 are generally equivalent to those described hereinabove in relation to FIGS. 1–4.

In view of the fact that the angle of slope of the blades 49 is preferably infinitely variable, depending on the outer circumference of those blades 49 and at which point one should choose to measure the angle or drop along the radius of those blades 49, the drop of the blades is best described in terms of dimensional increments of drop per increment of radial degree of circumference such as, for example, 1" of drop per 10° of circumference. Hereinafter, this will be referred to as "blade drop angle".

The criteria generally applicable to determining the most advantageous blade drop angle is, firstly, that too shallow a drop angle requires the impeller 11 to be rotated at a significantly increased RPM in order to move a given volume of fluid in a linear direction. Too fast of an RPM can be detrimental where the impeller assembly 35 is used to move "floating" surface solids into the central zone of a fluid in a given chamber. Such increased speed of the movement of the blades 49 creates increased abrasion and wear on the blade surfaces as the solids are moved over and under them. In addition, too fast of an RPM tends to induce a greater flow of ambient atmospheric gases into the fluid along with the solids being included. On the other hand, the steeper the angle of blade drop, the more horsepower is required for the drive motor 61 per given RPM. Also, the steeper the drop angle of the blades 49, per a given height of the impeller 11, the more choppy and turbulent the movement of fluid through the blades becomes. In addition, a steeper drop angle of the blades 49 tends to induce radial flow patterns between the blades 49 extending outwardly from the hub 21 to be diverted by the interior of the drum 39 at the radial periphery 17 of the impeller 11. Such radial flow tends to divert the linear flow of fluid through the impeller 11. If the height of the impeller 11 is increased and a steep blade 49 drop angle is maintained, the choppy and turbulent movement of the fluid diminishes, but the internal radial flow increases. In other words, steep drop angle blades 49 tend to induce more turbulence and internal radial flow in the fluid as it moves through those blades 49, which, in turn, tends to hinder the smooth linear flow development at the exit end of the impeller assembly 35.

In regard to the number of blades 49 included in the impeller 11, the criterion is one of maximizing the amount of linear flow through the impeller assembly 35, while minimizing the tendency to create turbulence, by inducing a smooth flow of fluid as opposed to a choppy flow. Inducement of a smooth flow of fluid through the impeller assembly 35 requires that there be generally more space between the blades 49 of the impeller 11. Thus, in this sense, a single blade 49 would be the optimum, however, two blades 49 will move twice as much fluid volume per revolution of the impeller assembly as a single blade 49, and accordingly, four blades 49 will move four times as much volume of fluid through the impeller assembly as a single blade 49. Thus, the criterion for design becomes one of ascertaining the maximum number of blades 49 that can be utilized while still maintaining sufficient space between the blades 49 and a shallow enough drop angle of each blade 49 to insure a smooth flow of fluid. In the preferred embodiment of this invention, three blades 49 are conventionally used. However, impeller assemblies 35 with two blades 49, as well as impeller assemblies 35 with four blades 49, have both been successfully used.

Another element which tends to induce smoother flow of fluid through the impeller assembly 35 is the length of blades 49, the principle being that the longer the length of blades 49 and the more surface area of each blade 49, the smoother the flow of fluid will tend to be. Thus, the object is to provide as much surface area per blade 49 as is possible, but with consideration for the previous criteria. The effect of increasing smoothness of flow begins to drop off rapidly at a point just past that in which the blades 49 begin to overlap 59 each other. Thus, infinite extension of the surface area of each of the blades 49 by a continuation of the volute of the impeller 11 is of little value beyond the point of blade overlap 59. Blade overlap 59 in the sense used here is intended to mean the point where the leading edge 47 of a given blade 49 extends over the trailing edge 57 of the next succeeding blade 49 around the radial periphery 17 of the impeller 11.

It is also important to have a sufficient number of blades 49 to balance the impeller 11. In this regard, the blades 49 should be spaced equidistantly around the radial periphery 17 of the impeller 11, all blade drop angles should be equivalent with each other in any given impeller 11, and the surface area and length of the blades should be equivalent.

The height of the impeller 11 merely needs to be sufficient to eliminate the need for too steep a blade drop angle and to provide sufficient blade surface area and length to induce a smooth flow of the fluids passing through the impeller 11. Preferably, the height of the impeller 11 is sufficient to include a slight overlap 59 of the blades 49 in combination with a relatively shallow blade drop angle to promote a smooth, non-turbulent flow of the fluid.

Figure 2:
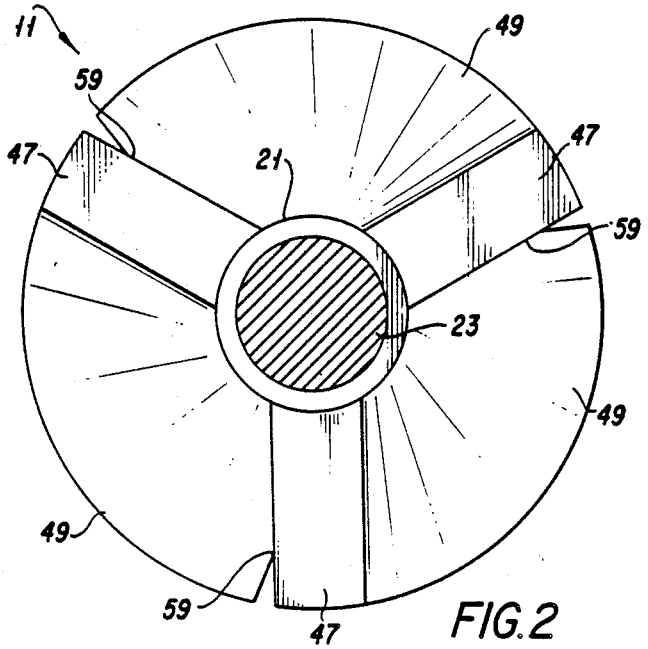
FIG. 2 illustrates a planned view of the impeller as viewed from I—I of FIG. 1.

Referring to FIGS. 2 and 6, the blade overlap 59 is illustrated. As mentioned before, the drum 39 or 39' of the impeller assembly 35 or 35', respectively, is generally in the form of a hollow cylindrical section and is mounted or fixed to the impeller 11 either by way of attachment or by way of being manufactured in a single piece inclusive with the impeller 11'. These two alternate embodiments are illustrated, as mentioned before, in FIGS. 4 and 5. Preferably, the drum 39 or 39', in relation to the impeller 11 or 11', respectively, should extend beneath or lower than the trailing edges 57 of the impeller blades 49 or 49', respectively. The reason for this extension is to produce a jet effect of the fluid which has just left the zone of the impeller 11 or 11', thus inducing an elongated projection of the linear flow of the fluid along the axis of rotation of the impeller assembler 35 or 35', and to further curtail or eliminate any radial turbulence or vortex effect that might be created adjacent to those trailing edges 57 of the impeller blades 49 or 49', respectively. The whole of the drum 39 or 39' prevents radial flow of fluid, and any solids included therein, as such passes through the blades 49 or 49', respectively, of the impeller 11 or 11'.

Preferably, the height of the drum 39 or 39' should extend upwardly beyond the leading edges 47 of the impeller 11 or 11', respectively, at least to some extent. However, there are limitations on the maximum extent of this height beyond the leading edge 47. If the height of the drum 39 or 39' is extended too far above the leading edges 47 of the impeller 11 or 11', respectively, tumbling and choppiness will begin to occur, causing turbulence within the flow of fluid which is encompassed by the upper extension of the drum 39 or 39' above the leading edges 47 of the impeller 11 or 11', respectively. Thus, the maximum extent to which the drum 39 or 39' should be extended is to that point where the turbulence begins to occur. On the other hand, extensions of the drum 39 or 39', to a point below that at which turbulence begins to occur, tends to enhance the smooth and linear flow of fluid into the impeller 11 or 11', respectively, although the impeller assembly 35 or 35', as described hereinabove, operates quite satisfactorily when the height of the drum 39 or 39' is equal to the height of the leading edges 47 of the impeller 11 or 11', respectively, in many applications.

The following chart includes examples of preferred dimensional characteristics of the impeller assembly 35 and 35' for several diameters. Included in this chart are the typical hub diameters, typical height extensions of drums above the leading edges of the impeller blades, typical extensions of drums below the trailing edges of the impeller blades, and the typical number of blades. Also included is a listing of the preferred typical blade drop angles.

TYPICAL IMPELLER CONFIGURATIONS

| Diameter | Hub Diameter | Extension above drum leading edges | Drum extension below trailing edges | Linear drop per degree of circum. | No. of blades |
|---|---|---|---|---|---|
| 16" | 4½" | 2" | 1" | 1/16" | 3 |
| 20" | 8½" | 2½" | 1½" | 1/16" | 3 |

-continued

| TYPICAL IMPELLER CONFIGURATIONS | | | | | |
|---|---|---|---|---|---|
| Diameter | Hub Diameter | Extension above drum leading edges | Drum extension below trailing edges | Linear drop per degree of circum. | No. of blades |
| 24" | 8½" | 2½" | 1½" | 1/16" | 3 |

It should be reemphasized that these are examples of the typical preferred dimensions and there is no intent to make this chart definitive of the overall scope of the invention described herein.

Figure 7:
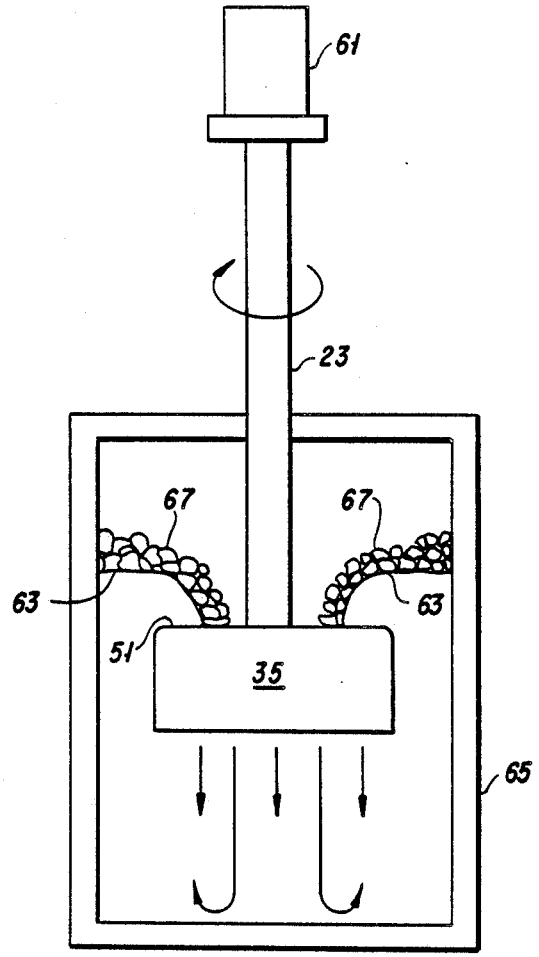
FIG. 7 is an elevational, cross-sectional schematic of the system for immersing solids into fluids.

As inferred above, there are two basic preferred applications of the impeller assembly described hereinabove. The first of these is illustrated in FIG. 7. Referring to FIG. 7, the object of the first alternate preferred application of the present invention is to entrain either light density solids or high ratio of surface area to volume solids, both of which tend to "float" on the surface of a liquid. In the arrangement shown in FIG. 7, the impeller assembly 35 is located adjacent to, but beneath, the surface level 63 of the fluid within a container 65. The depth at which the upper end 51 of the drum 39 is located below the surface level 63 is that depth which is sufficient to create a gravity flow of the fluid, along with the solids 67 floating on the surface of that fluid, over that upper end 51 and downwardly through the impeller 11 (not shown in FIG. 7).

There are several additional considerations beyond those mentioned hereinabove in regard to the design of the elements of the impeller assembly 35 which need to be considered in regard to the application of the present invention illustrated in FIG. 7. The height of the drum 39 above the leading edges 47 of the impeller blades 49 needs to be sufficient enough to create the foregoing gravity flow of the surface zone fluid and the solids 67 floating thereon, but should not be so high that the gravity flow begins to tumble the combined fluid and solid, thus creating turbulence. Such turbulence and tumbling action create interruptions in the flow of fluid into the impeller assembly 35 and, in this application specifically, tend to include, by entrainment, surrounding atmospheric gases.

The depth of the drum 39 below the trailing edges 57 of the impeller blades 49 must be sufficiently great to create the jet effect of the linear flow of fluid as described hereinabove. Beyond that, this dimension is only controlled by the depth of the container 65.

In the application of the present invention, illustrated in FIG. 7, the impeller blades 49 are spaced sufficiently apart to avoid compaction of the solids between those blades and preferably to prevent contact of the solids with the surfaces of the blade thereby producing a flow of fluid such that the solids are entirely entrained therein and the fluid, alone, is in contact with the surface areas of the impeller blades 49. Such a design tends to curtail or minimize the amount of wear by abrasion caused to the surface areas of the impeller blades 49.

Figure 8:
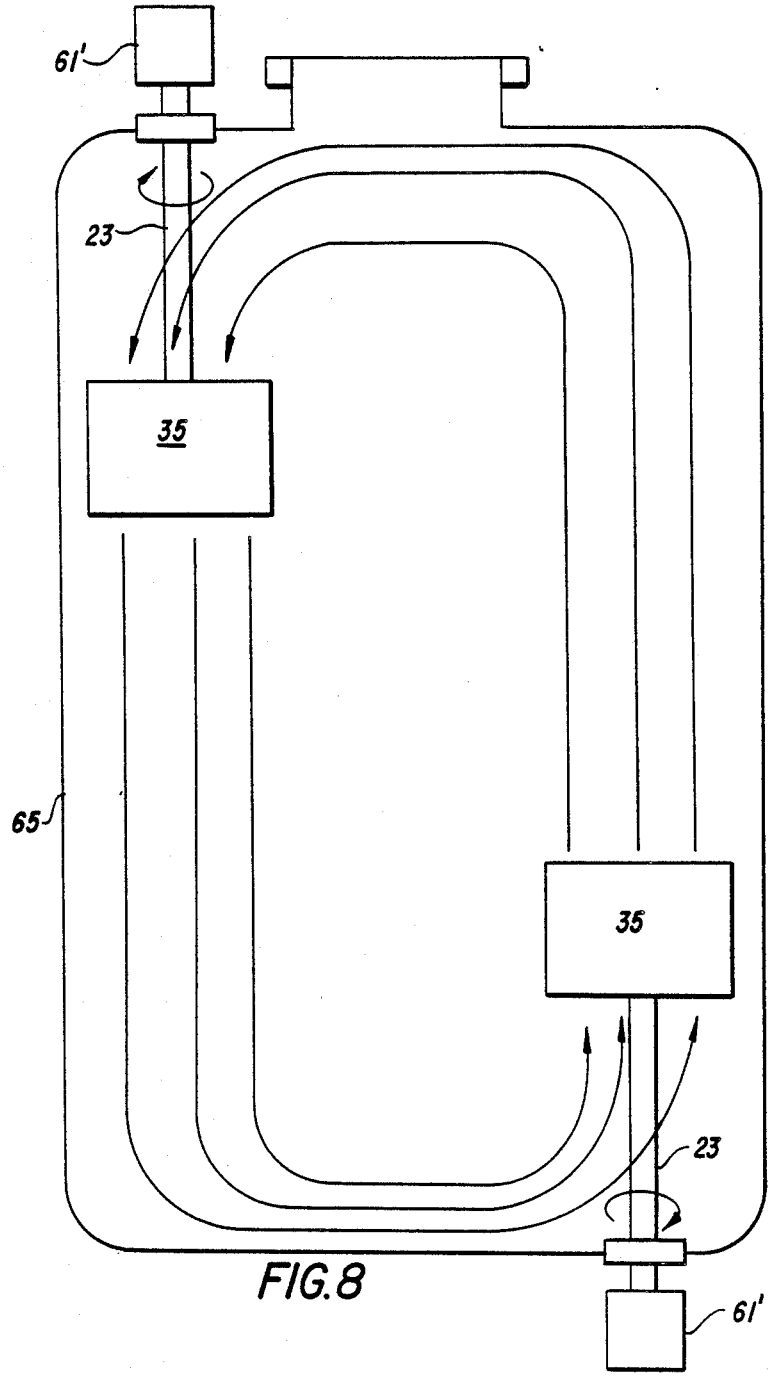
FIG. 8 is an elevational, cross-sectional schematic of the system for inducing linear flow paths within a container.

The second alternate preferred application of the present invention is illustrated in FIG. 8. In this alternate application, the impeller assembly 35 is used to create linear flow of a fluid within a container 65, the object being to induce a smooth circulation of the fluid within the confines of that container 65. As illustrated in FIG. 8, two separate impeller assemblies 35 are utilized. Such an arrangement is more applicable to a relatively large container. However, with smaller containers it is not necessary to have two impeller assemblies 35 as it is has been found that in many cases a single impeller assembly 35 is sufficient to create the fluid circulation desired. It is also possible to have multiple impeller assemblies 35, beyond a quantity of two, placed strategically in relation to the container 65 to further enhance the positive circulation of the fluid by the inducement of linear fluid flows.

In the alternate application of the present invention illustrated in FIG. 8, it is not necessary that the upper end 51 of the drum be extended above the leading edges 47 of the impeller blades 49. Rather, the upper end 51 of the drum 39 can be at the same height or elevation as the leading edges 47 of the impeller blades 49, but no lower than those leading edges 47. It is preferred, however, that the upper end 51 of the drum 39 be extended upwardly at least a small amount above the leading edges 47 of the impeller blades 49 to further enhance the smooth flow of fluids to the impeller 11. In all other instances, the design criteria applicable to the impeller assemblies shown in FIGS. 1 through 6 is equally applicable to the impeller assemblies 35 shown in FIG. 8.

In all cases the impeller assembly 35 is rotated such that the leading edges 47 of the impeller blades 49 come into first contact with any portions of fluid which traverse through that impeller assembly 35.

According to the provisions of the patent statutes, what is considered to represent the best embodiments of the present invention, their preferred construction, and their best mode of operation have been illustrated and described. However, it is to be understood that, within the scope of the appended claims, the invention may be practiced otherwise than as specifically illustrated and described.

What is claimed is:

1. An axial flow impeller assembly comprising:

(a) impeller means comprising;

(i) hub means adapted to be rotatably connected to drive means; and (ii) at least one impeller blade, mounted concentrically to said hub such that rotation of said hub means will cause concurrent and concentric rotation of said at least one impeller blade; and (b) drum means, comprising a concentrically hollow bored cylindrical section, concentrically mounted and fixed to the circumferential periphery of said at least one impeller blade such that rotation of said hub means and said at least one impeller blade will cause concurrent and concentric rotation of said drum means;

(c) said impeller assembly being adapted to linearly move fluid therethrough while substantially preventing radial flow of said fluid from the circumferential periphery of said at least one impeller blade; and (d) said at least one impeller blade having a drop angle which is sufficiently shallow to substantially prevent fluid turbulence and radial flow of fluids within said impeller assembly.

2. The invention of claim 1 wherein blade consists essentially of three impeller blades equally.

3. An axial flow impeller assembly as in said at least one impeller blade is a square pitch variable blade angle propeller.

4. An axial flow impeller assembly as in claims 1 or 2 in which said drum means extends in height at least from the trailing edge to the leading edge of said at least one impeller blade.

5. An axial flow impeller assembly as in claims 1 or 2 in which said drum means extends in height at least from the trailing edge to beyond the leading edge of said at least one impeller blade.

6. An axial flow impeller assembly as in claims 1 or 2 in which said drum means extends in height from beyond the trailing edge to at least the leading edge of said at least one impeller blade.

7. An axial flow impeller assembly as in claims 1 or 2 in which said drum means extends in height from beyond the trailing edge to beyond the leading edge of said at least one impeller blade.

8. An axial flow impeller assembly as in claims 1 or 2, further comprising a drive shaft extending from said hub means concentric with the axis of rotation of said impeller means and adapted to rotatably connect said drive means to said hub means.

9. An axial flow impeller assembly as in claims 1, 2, in which said drum means forms an integral extension of said at least one impeller blade such that said drum means and said at least one impeller blade are a single piece.

* * * * *